US007397197B2

(12) United States Patent
Ohta

(10) Patent No.: US 7,397,197 B2
(45) Date of Patent: Jul. 8, 2008

(54) DISCHARGE LAMP LIGHTING CIRCUIT

(75) Inventor: Shinji Ohta, Shizuoka (JP)

(73) Assignee: Koito Manufacturing Co., Ltd., Minato-ku, Tokyo (JP)

( * ) Notice: Subject to any disclaimer, the term of this patent is extended or adjusted under 35 U.S.C. 154(b) by 2 days.

(21) Appl. No.: 11/410,456

(22) Filed: Apr. 24, 2006

(65) Prior Publication Data

US 2006/0238137 A1 Oct. 26, 2006

(30) Foreign Application Priority Data

Apr. 25, 2005 (JP) ..... P.2005-126620

(51) Int. Cl.
*H05B 37/02* (2006.01)

(52) U.S. Cl. ..... 315/226; 315/308

(58) Field of Classification Search ..... 315/209 R, 315/219, 224, 225, 226, 291, 307, 308, DIG. 2, 315/DIG. 5, DIG. 7
See application file for complete search history.

(56) References Cited

U.S. PATENT DOCUMENTS 6,437,515 B1 * 8/2002 Kamoi et al. ..... 315/209 R
7,005,808 B2 * 2/2006 Ohta et al. ..... 315/226
7,019,465 B2 * 3/2006 Muramatsu et al. ..... 315/226
2005/0062443 A1 * 3/2005 Ohta et al. ..... 315/308

FOREIGN PATENT DOCUMENTS

JP 07-142182 6/1995

* cited by examiner

*Primary Examiner*—Thuy Vinh Tran
(74) *Attorney, Agent, or Firm*—Fish & Richardson P.C.

(57) ABSTRACT

A discharge lamp lighting circuit includes a DC/AC converter, a starting circuit, a control unit, a plurality of switching elements driven by the control unit and a series LC resonance circuit. At the time of lighting the discharge lamp, the driving frequency of the switching elements is set to a value higher than a resonance frequency at a time of lighting the discharge lamp thereby to drive and control the switching elements. When the driving frequency reduces and the extinction of the discharge lamp is detected, the driving frequency is shifted to a frequency region which is higher than a resonance frequency at a time of extinguishing the discharge lamp thereby to restart the lamp. Further, when the driving frequency reduces to a value lower than the resonance frequency at a time of lighting the discharge lamp during the lighting of the discharge lamp, the driving frequency is restored to a frequency region higher than the resonance frequency at a time of lighting the discharge lamp.

6 Claims, 12 Drawing Sheets

DISCHARGE LAMP LIGHTING CIRCUIT

The present application claims foreign priority based on Japanese Patent Application No. 2005-126620, filed Apr. 25, 2005, the content of which is incorporated herein by reference.

BACKGROUND OF THE INVENTION

1. Technical Field

The present invention relates to a discharge lamp lighting circuit to maintain the lighting state thereof and to restart at the time of the extinction or turning-off thereof.

2. Related Art

As a lighting circuit for a discharge lamp such as a metal halide lamp used for an illumination light source for a vehicle, there is the configuration which includes a DC power source circuit having a DC-DC converter, a DC/AC converter and a starting circuit. For example, this configuration is arranged in a manner that a DC input voltage from a battery is converted into a desired voltage by the DC power source, then the desired voltage is converted into an AC output by the DC/AC converter of the succeeding stage, and a start signal is superimposed on the AC output and supplied to the discharge lamp (see Japanese Patent document JP-A-7-142182, for example).

The lighting control of the discharge lamp is performed in a manner that an output voltage at the time of no-load or an open circuit voltage (hereinafter referred to OCV) in a state (extinction state) before lighting the discharge lamp is controlled to apply the start signal to the discharge lamp thereby to light or turn on the discharge lamp, and thereafter the discharge lamp is shifted to a steady lighting state while reducing a transient input power.

A switching regulator using a transformer, for example, is employed as the DC power source circuit. A full-bridge configuration using plural pairs of switching elements, for example, is employed as the DC/AC converter.

According to the configuration of performing the two-stage conversion of the DC voltage conversion and the DC/AC conversion, since the size of the circuit becomes large, this configuration is not suitable for miniaturization. As a measure to obviate such a problem, there is the configuration which employs the one-stage voltage conversion of the DC/AC converter thereby to supply a boosted voltage to the discharge lamp.

For example, there is the configuration which includes a series resonance circuit and is arranged to boost a resonance voltage by a transformer and electric power is supplied to the discharge lamp based on the boosted voltage. The series resonance circuit constituted by a capacitor and an inductance element has frequency characteristics almost symmetrical with respect to the resonance frequency and an output voltage, and an electric power can be controlled by changing the driving frequency of a semiconductor switching element constituting the DC/AC converter. The series resonance circuit has a tendency that the output voltage reduces in accordance with the increase of the frequency in the frequency range (an inductive area or a phase delay area) higher than the resonance frequency, whilst the output voltage reduces in accordance with the reduce of the frequency in the frequency range (a capacitive area or a phase advance area) lower than the resonance frequency.

In the OCV control in the extinction state before the lighting after turning-on of the power source, when the driving frequency of the semiconductor switching element is reduced in the frequency range higher than a series resonance frequency "Foff", the OCV value is increased. When the OCV value reaches a target value, a starting high voltage pulse is generated and applied to the discharge lamp. When the discharge lamp lights or turns on, the driving frequency is shifted to a frequency range higher than a series resonance frequency "Fon" (higher than Foff) thereby to start the electric power control of the discharge lamp.

In the control relating to the driving frequency of the semiconductor switching element on the condition that the output is controlled on the higher frequency side than the resonance frequencies (Foff and Fon) at the time of the extinction and lighting of the discharge lamp, respectively, there arises an abuse caused by a fact that the driving frequency of the semiconductor switching element is one-sidedly controlled so as to be reduced by the reduction of the power source voltage or the grounding at the output stage etc.

That is, in the frequency region (the inductive area) higher than the resonance frequency, the driving frequency is controlled so as to be reduced in order to increase the output voltage and the power, whilst the driving frequency is controlled so as to be increased in order to reduce the output voltage and the power. Thus, the aforesaid control acts on the output voltage and the power undesirably when a control operation point enters into the frequency region (the capacitive area) lower than the resonance frequency due to a some reason (for example, when the input voltage from a battery etc. reduces or when it is determined that the discharge lamp is extinguished by the grounding). That is, when the driving frequency is reduced in order to increase the output, the output reduces accordingly, so that the driving frequency is controlled so as to be further reduced. This is because the output voltage tends to reduce with respect to the reduction of the frequency in the frequency region lower than the resonance frequency, whereby the driving frequency of the semiconductor switching element reduces endlessly and it becomes impossible to escape from such a state. As a result, there may arise such a problem that the discharge lamp can not be lighted again or the controlling of a target power becomes difficult. Thus, it is required to provide a measure for eliminating such a problem.

SUMMARY OF THE INVENTION

The disclosure below describes a measure for preventing a phenomenon that the driving frequency of semiconductor switching elements constituting a DC/AC converter utilizing series resonance is kept to be lower than a resonance frequency, thereby to maintain the lighting state of a discharge lamp or guarantee the shift to a re-lighting operation.

In one aspect, the disclosure describes a discharge lamp lighting circuit including a DC/AC converter which receives a DC input voltage to perform a DC/AC conversion, a starting circuit which supplies a start signal to the discharge lamp and a control unit which controls an electric power output from the DC/AC converter.

The DC/AC converter includes a plurality of switching elements driven by the control unit, and a series resonance circuit having a capacitor and at least one of an inductance element and a transformer.

Supposing that a resonance frequency of the series resonance circuit at a time of extinguishing the discharge lamp is Foff and a resonance frequency of the series resonance circuit at a time of lighting the discharge lamp is Fon, at a time of lighting the discharge lamp, a driving frequency of the switching elements may be set to a value higher than the resonance frequency Fon thereby to drive and control the switching elements. Further, when it is detected that the driving frequency reduces and the discharge lamp is extinguished, the driving frequency may be shifted to a frequency region which is higher than the resonance frequency Foff. Alternatively, when it is detected that the driving frequency reduces to a value lower than the resonance frequency Fon during the lighting of the discharge lamp, the driving frequency may be restored to a frequency region higher than the resonance frequency Fon.

In the configuration of controlling the driving frequency of the switching elements in the higher frequency side region than the resonance frequency at the time of the extinction and the lighting of the discharge lamp, when the driving frequency reduces than the resonance frequency Fon, the driving frequency is temporarily increased at the time of the extinction of the discharge lamp thereby to restart the lamp. Further, when the frequency reduction occurs at the time of the lighting of the discharge lamp, the driving frequency can be restored to the original frequency range while maintaining the lighting state.

One or more of the following advantages may be present in some implementations, For example, in order to prevent such a state that, at the time of the reduction of the power source voltage or the grounding etc., the driving frequency of the switching elements reduces and is kept in a capacitive region on the lower frequency side than the resonance frequency, the control is made so as to restore the driving frequency to an inductive region on the higher frequency side than the resonance frequency Fon or Foff.

For example, when it is detected that the driving frequency reduces and the discharge lamp is extinguished, the driving frequency is set to an allowable upper limit frequency higher than the resonance frequency Fon thereby to restart the lamp, whereby the re-lighting operation at the time of the extinction of the lamp can be guaranteed.

As to the detection of the reduction of the driving frequency and the extinction state of the discharge lamp, the discharge lamp lighting circuit further may include a voltage detector which detects a lamp voltage applied to the discharge lamp, and a current detector which detects a lamp current flowing into the discharge lamp, and wherein when a state may be continued for a predetermined time period or more that the lamp voltage detected by the voltage detector is lower than a threshold value and the lamp current detected by the current detector is lower than a threshold value, the driving frequency may be shifted to the frequency region which is higher than the resonance frequency Foff (in this case, the complication etc. of the circuit configuration and the control method etc. can be prevented).

Further, at the time of the lighting of the discharge lamp, a measure may be taken that the driving frequency is shifted to the inductive region while maintaining the lighting state of the discharge lamp thereby to prevent the continuous reduction of the driving frequency. For example, the discharge lamp lighting circuit may further include a current detector which detects a lam current flowing into the discharge lamp, and a detection unit which detects the driving frequency or a control voltage for the driving frequency, and wherein when a state may be continued for a predetermined time period or more that the lamp current detected by the current detector reduces and reduction of the driving frequency is detected by the detection unit, the driving frequency may be shifted to the frequency region which is higher than the resonance frequency Fon.

According to the aforesaid frequency shift control, the reliability and the safety at the time of running etc. can be improved when it is applied to a vehicle lamp, for example.

Other features and advantages may be apparent from the following detailed description, the accompanying drawings and the claims.

DETAILED DESCRIPTION OF THE INVENTION

Figure 1:
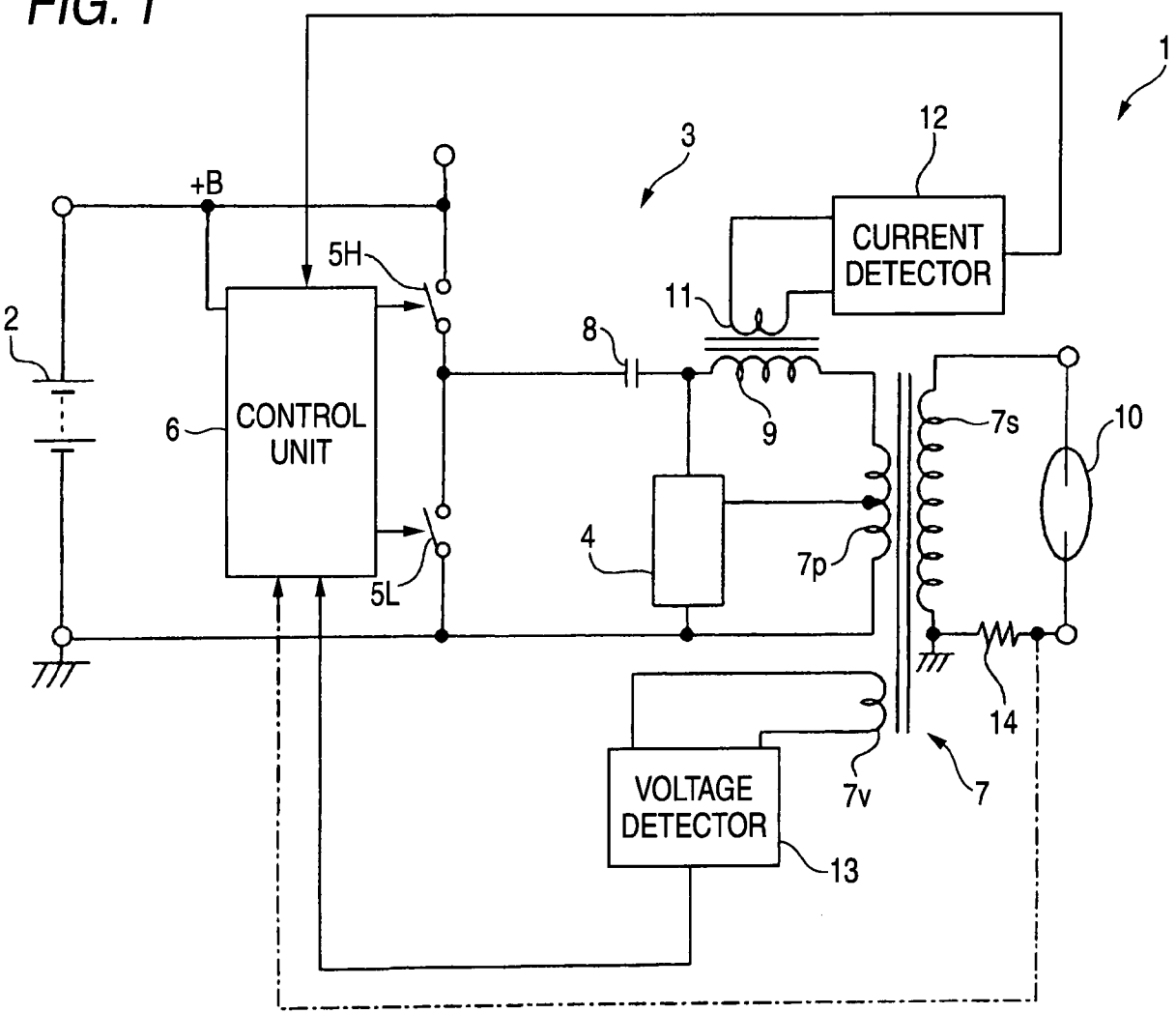
FIG. 1 is a diagram showing an example of the basic configuration according to the invention.

FIG. 1 is a diagram showing an example of the basic configuration according to the invention, in which a discharge lamp lighting circuit 1 includes a DC/AC converter 3 for receiving power from a DC power source 2 and a starting circuit 4.

The DC/AC converter 3 is provided so as to receive a DC input voltage (see +B in the figure) from the DC power source 2 and perform the AC conversion and the boosting. In this embodiment, the DC/AC converter includes two switching elements 5H, 5L and a control unit 6 for performing the driving control of these switching elements. That is, the one end of the switching element 5H on the high voltage side is coupled to the terminal of the power source, and the other end of this switching element is grounded via the switching element 5L on the low voltage side. The control unit 6 alternatively turns on and off the two switching elements 5H, 5L. Although each of the switching elements 5H, 5L is represented by a symbol of a switch for the sake of the simplification, a semiconductor element such as a field effect transistor (FET) or a bipolar transistor is used as each of these switching elements.

The DC/AC converter 3 has a transformer 7 for power transmission and boosting. In this embodiment, the transformer employs the circuit configuration utilizing the resonance phenomenon caused by a resonance capacitor 8 and an inductor or inductance component. That is, as such a configuration, there are the following three modes, for example.

(I) A mode utilizing the resonance caused by the resonance capacitor 8 and an inductance element.

(II) A mode utilizing the resonance caused by the resonance capacitor 8 and the leakage inductance of the transformer 7.

(III) A mode utilizing the resonance caused by the resonance capacitor 8, the inductance element and the leakage inductance of the transformer 7.

First, in the mode (I), there is such a configuration that an inductance element 9 such as a resonance coil is additionally provided, then, for example, the one end of the inductance element is coupled to the resonance capacitor 8, then the resonance capacitor 8 is coupled to a coupling point between the switching elements 5H and 5L, and the other end of the inductance element 9 is coupled to the primary winding 7*p* of the transformer 7.

In the mode (II), it is not necessary to add a resonance coil etc. by utilizing the inductance component of the transformer 7. That is, the one end of the resonance capacitor 8 is coupled to the coupling point between the switching elements 5H and 5L, and the other end of the resonance capacitor 8 is coupled to the primary winding 7*p* of the transformer 7.

In the mode (III), a series composite reactance of the inductance element 9 and the leakage inductance can be used.

In each of these modes, the driving frequency of the switching elements 5H. 5L is defined to be equal to or larger than the series resonance frequency by utilizing the series resonance of the resonance capacitor 8 and the inductive element (the inductance component or the inductance element), and the switching elements are alternatively turned on and off thereby to light in a sine wave manner the discharge lamp 10 (a metal halide lamp etc. used for a vehicle lamp) coupled to the secondary winding 7*s* of the transformer 7. In the driving control of the respective switching elements by the control unit 6, it is necessary to drive the respective elements in an opposite manner so that the two switching elements are not placed in an on state simultaneously (depending on the on-duty control etc.). As to the series resonance frequency, supposing that the resonance frequency before the lighting after turning-on of the power source is "Foff", the resonance frequency in the lighting state is "Fon", the electrostatic capacitance of the resonance capacitor 8 is "Cr", the inductance of the inductance element 9 is "Lr" and the primary side inductance of the transformer 7 is "Lp", $Foff=1/(2\cdot\pi\cdot\sqrt{(Cr(Lr+Lp))}$ in the state before the lighting of the discharge lamp after turning-on of the power source in the mode (III), for example. For example, if the driving frequency is lower than Foff, the loss of the switching elements becomes large and so the efficiency is degraded. Thus, the switching operation is performed at the frequency range higher than Foff. Further, after the lighting of the discharge lamp, Fon becomes almost equal to $1/(2\cdot\pi\cdot\sqrt{(Cr(Lr\times Lp))}$. In this case, the switching operation is performed at the frequency range higher than Fon.

After the turning-on of the power source of the lighting circuit, the OCV is controlled at the frequency near Foff in the extinction or turn-off state (no load state) of the discharge lamp. When the discharge lamp is shifted to the lighting state after the start signal is generated and the discharge lamp is started by the start signal, it is preferable to perform the lighting control at the frequency range higher than Fon.

The starting circuit 4 is provided in order to supply the start signal to the discharge lamp 10. The output voltage of the starting circuit 4 at the time of the starting is boosted by the transformer 7 and applied to the discharge lamp 10 (the start signal is superimposed on the AC-converted output and supplied to the discharge lamp 10). In this embodiment, there is shown a mode in which one of the output terminals of the starting circuit 4 is coupled to a point on the way of the primary winding 7*p* of the transformer 7 and the other output terminal of the starting circuit is coupled to the one end (ground side terminal) of the primary winding 7*p*. The embodiment is not limited to the aforesaid arrangement, and may be arranged, for example, in a mode of obtaining the input voltage to the starting circuit from the secondary side of the transformer 7 or in a mode of providing an auxiliary winding (an auxiliary winding 11 described later) constituting a transformer together with the inductance element 9 to obtain the input voltage to the starting circuit from the auxiliary winding.

As shown in FIG. 1, in the circuit configuration in which the DC/AC converter 3 performs the DC/AC conversion and the boosting thereby to perform the power control of the discharge lamp, in the case of detecting a current flowing into the discharge lamp 10 and a voltage applied to the discharge lamp 10, for example, a winding is added to the resonance inductance element 9 or a detecting winding or a detecting terminal is added to the transformer 7 thereby to obtain the voltage detection value and the current detection value of the discharge lamp.

In the example shown in FIG. 1, the auxiliary winding 11 for forming the transformer together with the inductance element 9 is provided in order to detect a current corresponding to the current flowing into the discharge lamp 10. The output of the auxiliary winding 11 is sent to a current detector 12. That is, the current detection of the discharge lamp is performed by using the inductance element 9 and the auxiliary winding 11, and the detection result is sent to the control unit 6 and used for the power control and the discrimination of the on and off states of the discharge lamp 10.

The voltage applied to the discharge lamp 10 is detected based on the output of a detection winding 7*v* provided at the transformer 7, for example. In this embodiment, the output of the detection winding 7*v* is sent to a voltage detector 13 and this means obtains a detection voltage corresponding to the voltage applied to the discharge lamp 10. The detection voltage is sent to the control unit 6 and used for the power control and the discrimination of the on and off states of the discharge lamp 10.

Various modes can be employed in order to detect the current or voltage of the discharge lamp. For example, in FIG. 1, the current or voltage of the discharge lamp can be detected by providing a lamp current detection resistor 14 on the secondary side of the transformer 7, for example, regardless of the circuit configuration.

Figure 2:
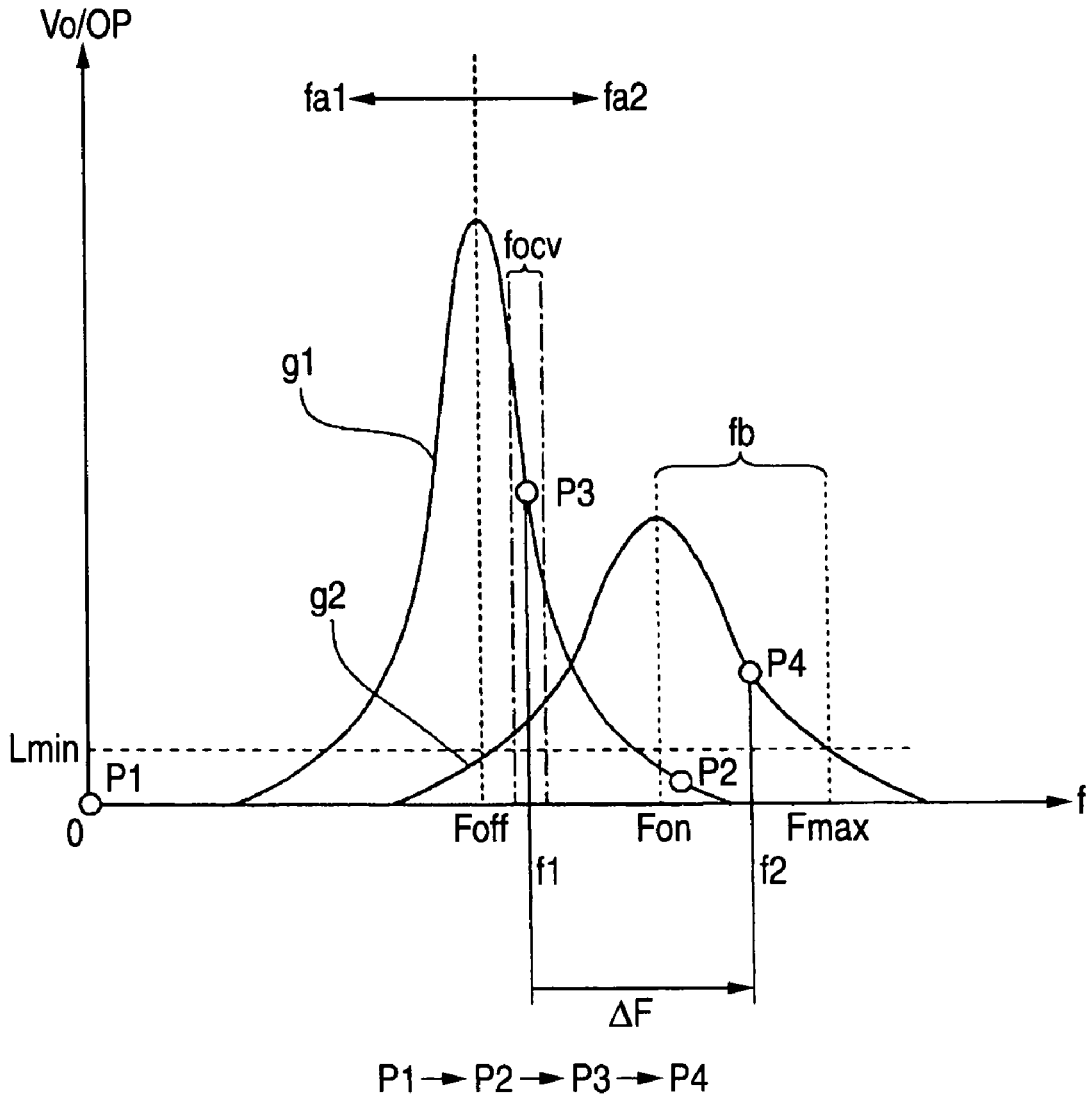
FIG. 2 is a schematic graphical diagram for explaining the frequency characteristics relating to an LC series resonance.

FIG. 2 is a schematic graphical diagram for explaining the frequency characteristics in the case of utilizing the LC series resonance, in which the abscissa represents the frequency "f" and the ordinate represents the output voltage "Vo" or the output power "OP" of the lighting circuit. These graphs shows a resonance curve "g1" at the time of the extinction and a resonance curve "g2" at the time of the lighting of the discharge lamp.

The ordinate represents the output voltage "Vo" as to the resonance curve "g1", whilst the ordinate represents the output power "OP" as to the resonance curve "g2".

At the time of the extinction of the discharge lamp, the secondary side of the transformer 7 has a high impedance and the primary side of the transformer has a high inductance value, so that the resonance curve g1 with the resonance frequency Foff is obtained. At the time of the lighting of the discharge lamp, the secondary side of the transformer 7 has a low impedance (several tens to several hundreds Ω and the primary side of the transformer has a low inductance value, so that the resonance curve g2 with the resonance frequency Fon is obtained (at the time of the lighting, the voltage change value is relatively small and mainly the current changes largely).

The meanings of the respective signs in the drawings are as follows.

"fa1" is a frequency range of "f<Foff" (a capacitive region or a phase advanced region at the left side of "f=Foff").

"fa2" is a frequency range of "f>Foff" (an inductive region or a phase delayed region at the right side of "f =Foff").

"fb" is a frequency range positioned in the range of "f>Fon" (the frequency range in the lighting state and positioned within the inductive region at the right side of "f=Fon").

"focv" is the control range of the output voltage before the lighting (in the extinction state) (hereinafter called as "an OCV control range", and this is located near the Foff within the fa2).

"Lmin" is an output level capable of maintaining the lighting state of the discharge lamp.

"P1" is an operation point before the tuning-on of the power source.

"P2" is an initial operation point (within the region fb) just after the tuning-on of the power source.

"P3" is an operation point (within the focv) representing the arrival time point to the target value of the OCV at the time of the extinction.

"P4" is an operation point (within the region fb) after the lighting.

"f1" is the driving frequency of the switching elements (for example, the driving frequency at the operation point P3) just before the start of the lighting of the discharge lamp.

"f2" is the driving frequency of the switching elements (for example, the driving frequency at the operation point P4) at the time of starting the lighting of the discharge lamp.

"Fmax" is a frequency (allowable upper limit frequency) at the cross point between the g2 and the Lmin.

The flow of the lighting shift control relating to the discharge lamp will be described as follow in a sequential manner.

(1) The power source is turned on (P1→P2).

(2) The electric power is applied within the OCV control range focv (P2→P3).

(3) The start pulse is generated and applied to the discharge lamp (P3).

(4) After the starting of the discharge lamp, the lighting frequency (the driving frequency of the switching elements) is fixed for a constant time period (hereinafter called a frequency fixing time period) (P3).

(5) The operation is shifted to the power control within the fb (P3→P4).

At the time point just after the turning-on of the power source or just after the extinction after once turning the discharge lamp on, the driving frequency is increased temporarily (P1→P2) and then decreased gradually so as to approach the f1 (P2→P3).

The OCV control is performed within the focv to generate the start signal for the discharge lamp and the start signal is applied to the discharge lamp thereby to turn the lamp on. For example, in the OCV control, when the frequency is reduced and approached to the resonance frequency Foff from the high frequency side, the output voltage Vo gradually increases and reaches the target value at the operation point P3. According to a method of performing the OCV control in the region fa1 in the extinction state before lighting the discharge lamp, it is necessary to pay the attention to that the switching loss becomes quite large and the circuit efficiency degrades. Further, in a method of performing the OCV control in the region fa2, it is necessary to pay the attention to that a time period for continuously operating the circuit in the no-load state does not become longer than needed.

When the starting circuit 4 starts the discharge lamp at the time point P3, the driving frequency is kept at the constant value during the frequency fixing period and then the operation shifts to the region fb (see "ΔF" in the figure). In the frequency shift to the region fb from the OCV control range Focv, it is preferable to change the frequency continuously from the f1 to the f2 after starting the lighting of the discharge lamp.

As described above, in the configuration where the output voltage control is performed at the range fa2 on the frequency side higher than the resonance frequency Foff at the extinction state of the discharge lamp and the output voltage control is performed at the range fb on the frequency side higher than the resonance frequency Fon at the lighting state of the discharge lamp (the power is likely stabilized in the inductive region due to the suppressing action with respect to the current change), the driving frequency of the switching elements is controlled so as to be reduced in order to increase the output. Thus, for example, when the driving frequency enters into the region lower than the Fon in such a case where the DC input voltage to the lighting circuit reduces, the driving frequency reduces (the driving frequency reduces along the lower slope portion of the g2 positioned at the left side of the Fon shown in FIG. 2 and finally reduces to the minimum frequency) due to the frequency control intended to increase the output (that is, the control of reducing the driving frequency). Thus, the desired power can not be supplied to the discharge lamp.

When the ground fault occurs on the secondary side of the transformer 7, for example, the current does not flow through the lamp current detection resistor 14 (see FIG. 1), so that it is determined that the discharge lamp is extinguished. As a result, the OCV control is started in order to restart the lamp. However, when the ground fault occurs at the high voltage side terminal of the secondary winding 7*s* of the transformer 7, since the lamp voltage does not increase even if the driving frequency of the switching elements is reduced, the driving frequency is fallen in a state of being kept at the minimum frequency.

Thus, the following configuration may be employed as a measure of preventing a problem caused when the driving frequency reduces to a value lower than the Fon.

(A) A mode in which, when the driving frequency of the switching elements reduces and it is detected that the discharge lamp is extinguished, the driving frequency is shifted to the frequency range higher than the Foff and then the lamp is restarted.

(B) A mode in which, when it is detected that the driving frequency reduces lower than the Fon during the lighting state of the discharge lamp, the driving frequency is shifted to the frequency range higher than the Fon.

The mode (A) is arranged to guarantee the restart of the lamp as a relief measure in the case where, in the capacitive region lower than the resonance frequency Fon, the driving frequency reduces remarkably by the aforesaid control and so the discharge lamp is extinguished. The mode (B) is a measure, in the lighting state of the discharge lamp, for preventing the driving frequency from falling into such a low frequency state.

First, the mode (A) will be explained with reference to FIGS. 3 to 9.

Figure 3:
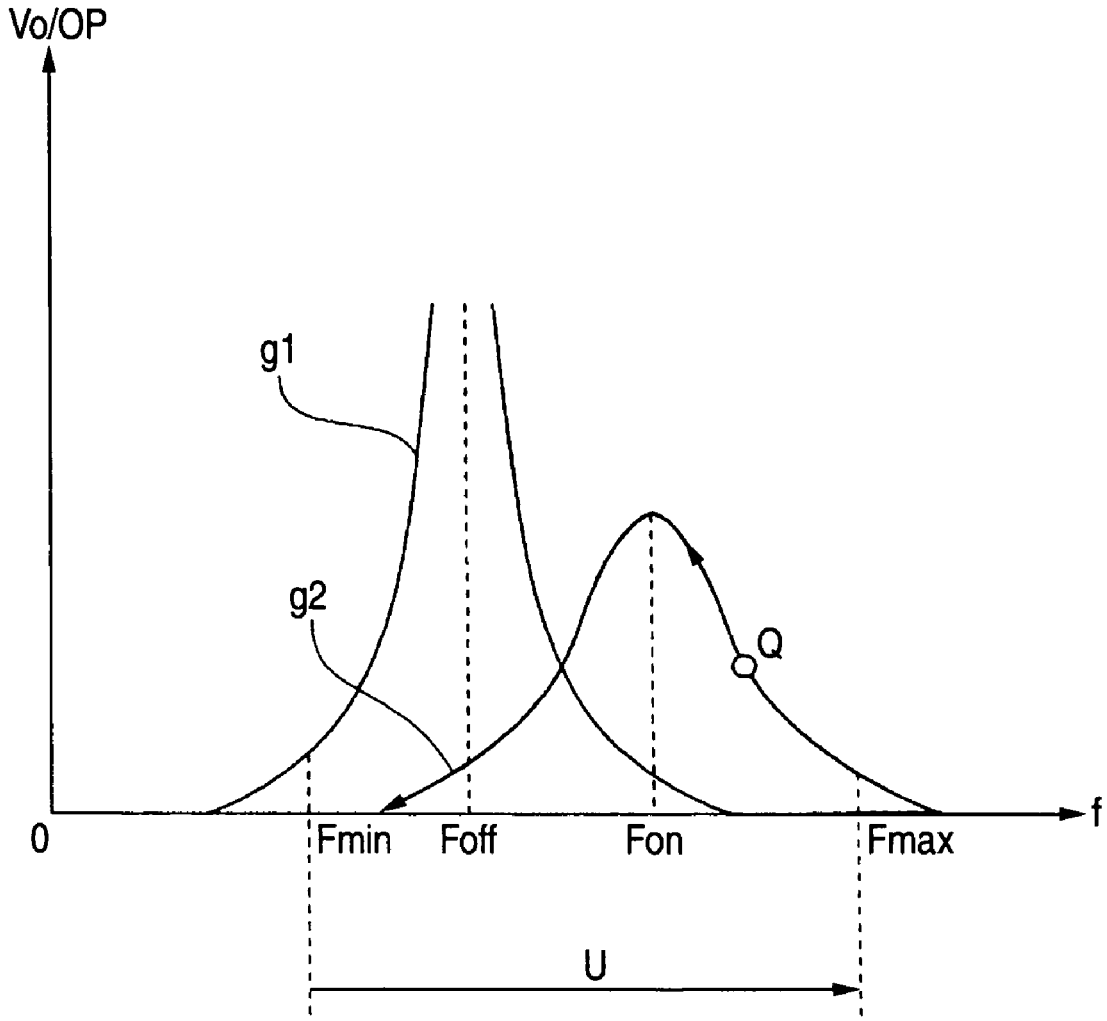
FIG. 3 is a diagram showing a control mode according to the invention together with FIGS. 4 to 9, and an explanatory diagram showing an example of the control for re-starting the lamp after the extinction of the discharge lamp.

FIG. 3 shows an example of the control in which, when the driving frequency reduces and the extinction of the discharge lamp is detected, the driving frequency is set to the Fmax higher than the Fon thereby to perform the restarting of the lamp. In this figure, the abscissa represents the frequency "f" and the ordinate represents the output voltage "Vo" or the output power "OP", and the resonance curves "g1" and "g2" are schematically shown.

When the driving frequency reduces in a manner that it enters into the region of the low frequency side range of Fon from an operation point "Q" positioned on the high frequency side of the Fon, the driving frequency reaches the minimum frequency "Fmin" shown in the figure as a result of such a control of reducing the frequency.

Thus, as shown by an arrow "U", the driving frequency is set to the Fmax higher than the Fon and the control for the restarting is started. That is, the driving frequency is temporarily increased and the driving frequency is reduced, whereby the control for increasing the OCV to the target value is performed.

In this embodiment, the driving frequency is shifted to the allowable upper limit frequency "Fmax" in view of the simplification etc. of the circuit configuration and the control. In short, when the discharge lamp is extinguished due to the reduction of the driving frequency, the driving frequency is shifted to the frequency range higher than the Foff thereby to surely start the OCV control (that is, the driving frequency is approached to the P3 from the high frequency side in the high frequency range of the resonance curve g1 in FIG. 2 thereby to increase the output voltage).

Figure 4:
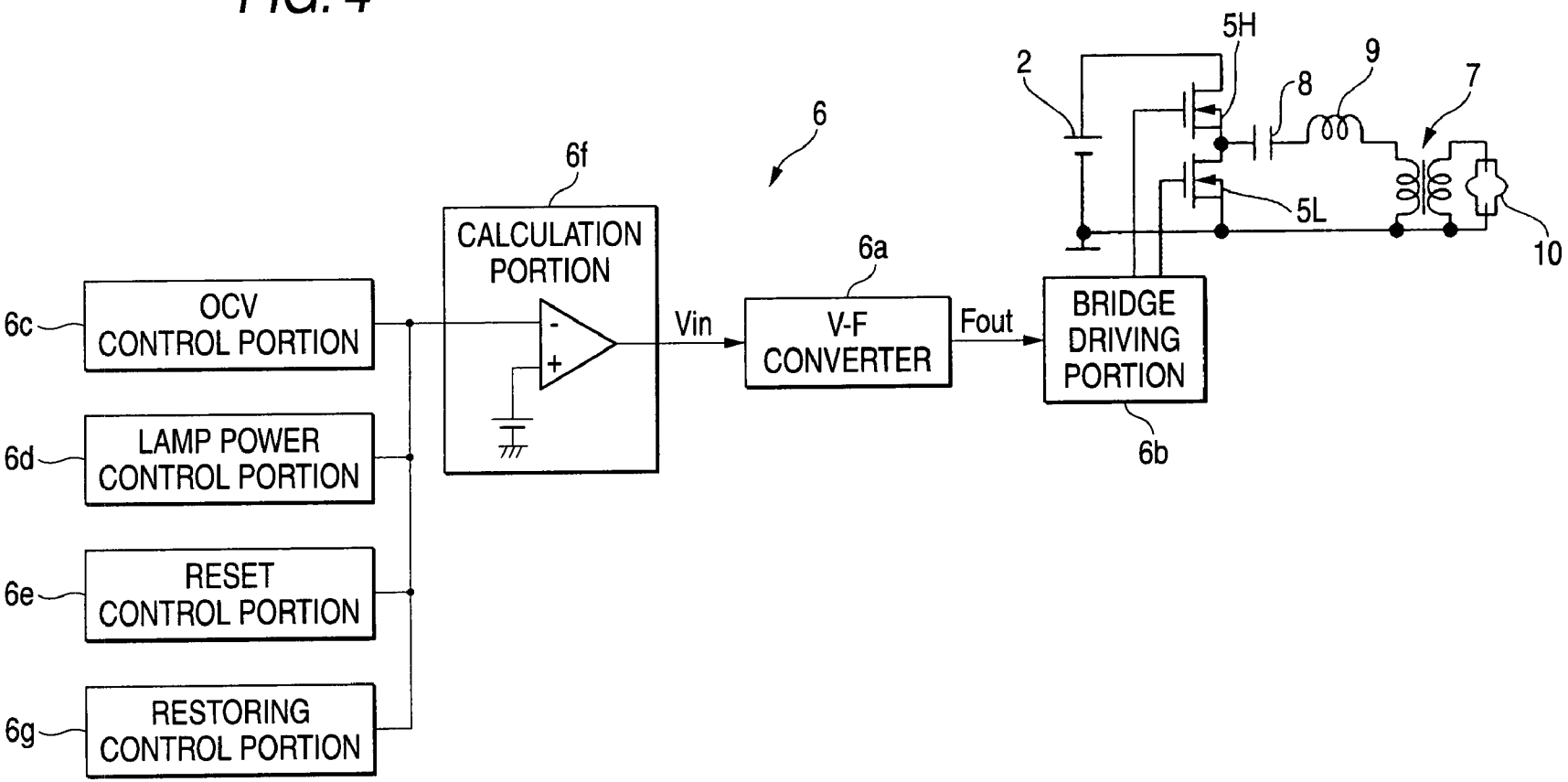
FIG. 4 is a diagram showing an example of the circuit configuration of a control unit.

FIG. 4 mainly shows the circuit configuration of the control unit 6 as an example of the circuit configuration relating to the mode (A).

This embodiment shows the configuration using a voltage-frequency converter (herein after referred to a "V-F converter") in which a frequency changes in accordance with an input voltage. In the figure, "Vin" represents the input voltage to the V-F converter 6*a* and "Fout" represents the frequency of an output voltage converted by the V-F converter 6*a*.

The V-F converter 6*a* has such a control characteristics that the Fout becomes lower as the Vin is higher. The output voltage of this converter is sent to a succeeding bridge driving portion 6*b*. The output signals of the bridge driving portion 6*b* are sent to the control terminals of the switching elements 5H, 5L, respectively. For example, the value of the Fout becomes lower as the value of the Vin is larger in the frequency range higher than the resonance frequency F of for Fon, so that the control is performed so as to increase the output power (or voltage). In contrast, the value of the Fout becomes higher as the value of the Vin is smaller, so that the control is performed so as to decrease the output power (or voltage).

In this manner, the Vin is a control voltage (frequency control voltage) relating to the frequency control of the switching elements. In this embodiment, the respective outputs of an OCV control portion 6*c*, a lamp power control portion 6*d*, a reset control portion 6*e* and a restoring control portion 6*g* described later are input into the V-F converter 6*a* via a calculation portion 6*f*.

The OCV control portion 6*c* serves to control the no-load or open circuit voltage (OCV) before the lighting of the discharge lamp and has a function of reducing the driving frequency to increase the output voltage to the discharge lamp in the OCV control. For example, the OCV control portion is configured by using an operational amplifier which receives the voltage detection signal of the discharge lamp as the input signal.

The lamp power control portion 6*d* serves to control the shift to the frequency region fb after starting the lighting of the discharge lamp and also control the power at the time of the steady lighting. For example, the lamp power control portion fixes the driving frequency of the switching elements 5H, 5L during the frequency fixing period just after the start of the lighting of the discharge lamp in response to a signal from a not-shown lighting/extinction discriminating circuit (a binary signal according to the lighting and extinction states of the discharge lamp), and increase the driving frequency of the switching elements upon the lapse of this period thereby to shift to the region fb.

In the frequency shift to the f2 from the f1 in FIG. 2, there is such a control mode of gradually approaching the f2 with a predetermined time constant or a control mode of, when a frequency between the f1 and the f2 is represented by "fw", setting the frequency change speed from the fw to the f2 to be smaller than the frequency change speed from the f1 to the fw.

The power control at the rated value is performed after the completion of the shift to the f2 from the f1.

The reset control portion 6*e* is a circuit for performing the frequency shift control explained with reference to FIG. 3 (the detailed configuration thereof will be explained later).

The calculation portion 6*f* receives the respective outputs from the OCV control portion 6*c*, the lamp power control portion 6*d*, the reset control portion 6*e* and the restoring control portion 6*g* described later. For example, an error amplifier is used for the calculation portion in a manner that the signals from the respective control portions are input to one of the input terminals thereof and a predetermined reference voltage is applied to the other of the input terminals thereof, whereby an error signal representing the comparison result between the inputs of these input terminals is output as the "Vin". Then, the output signal of the frequency Fout obtained by the V-F conversion is sent as a control signal to the switching elements 5H, 5L via the bridge driving portion 6*b*.

Figure 5:
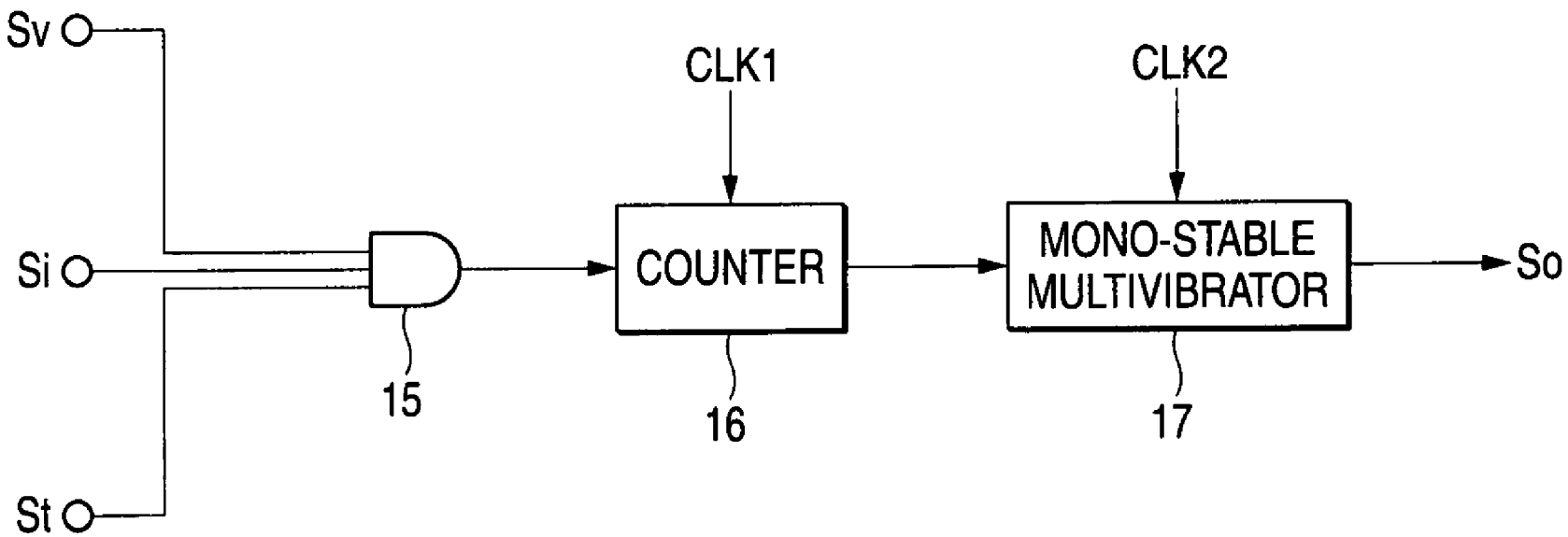
FIG. 5 is a block diagram showing an example of the configuration of a reset control portion.

FIG. 5 is a block diagram showing an example of the configuration of the reset control portion 6*e*, in which the meanings of respective signs in the drawings is as follows.

"Sv" is a level determination signal relating to the lamp voltage (when the lamp voltage is represented by "VL" and a threshold value for comparing with the lamp voltage is represented by "Vsh", the level determination signal is at a high level (hereinafter abbreviated as H) when VL<Vsh, whilst at a low level (hereinafter abbreviated as L) when VL≧Vsh).

"Si" is a lighting/extinction discriminating signal of the discharge lamp (when the lamp current is represented by "IL" and a threshold value for comparing with the lamp current is represented by "Ish", the lighting/extinction discriminating signal is at an H level when IL<Ish since it is determined to be the extinguished state of the discharge lamp, whilst at an L level when IL≧Ish since it is determined to be the lightened state of the discharge lamp).

"St" is a discriminating signal at the time of the lighting shift control of the discharge lamp (which represents an L level only during the frequency shift period to the region fb after starting the lighting of the discharge lamp, whilst represents an H level during the period other than the frequency shift period).

A circuit configuration for generating the lighting/extinction discriminating signal Si may be configured in a manner, for example, that the lamp current is detected, and it is determined that the lamp current value is zero or almost zero by a comparing means such as a comparator thereby to obtain a binary signal representing the determination result. In the case of applying the embodiment, it is possible to employ various kinds of lighting/extinction discriminating circuits.

These signals Sv Si and St are sent to a three-input AND gate 15, which in turn outputs a logical multiply output of these three signals to the reset terminal (R) of a counter 16 constituting a clock means. The counter 16 is supplied with a clock signal "CLK1" from a not-shown signal generation circuit and sends an output signal to a succeeding mono-stable multivibrator 17 when a predetermined number of the clock signals are counted.

The mono-stable multivibrator 17 receives a clock signal "CLK2" from a not-shown signal generation circuit and sends a signal "So" with a predetermined pulse width to the calculation portion 6*f*.

In this embodiment, when such a state is continued for a predetermined time period or more that the lamp voltage detected by the voltage detector 13 is smaller than the threshold value and the lamp current detected by the current detector 12 or the lamp current detection resistor 14 is smaller than the threshold value, the reset control portion 6*e* outputs the signal "So" to reduce the output of the calculation portion 6*f* and so the frequency of the signal output from the V-F converter 6*a* becomes temporarily high. Thus, the driving frequency of the switching elements is shifted to the frequency range higher than the resonance frequency Foff. For example, when it is detected that such two conditions are satisfied for a predetermined time period or more that the lamp voltage is smaller than the target value of the OCV and the lamp current is zero ampere or almost zero ampere, the reset operation for the restart is performed.

Figure 6:
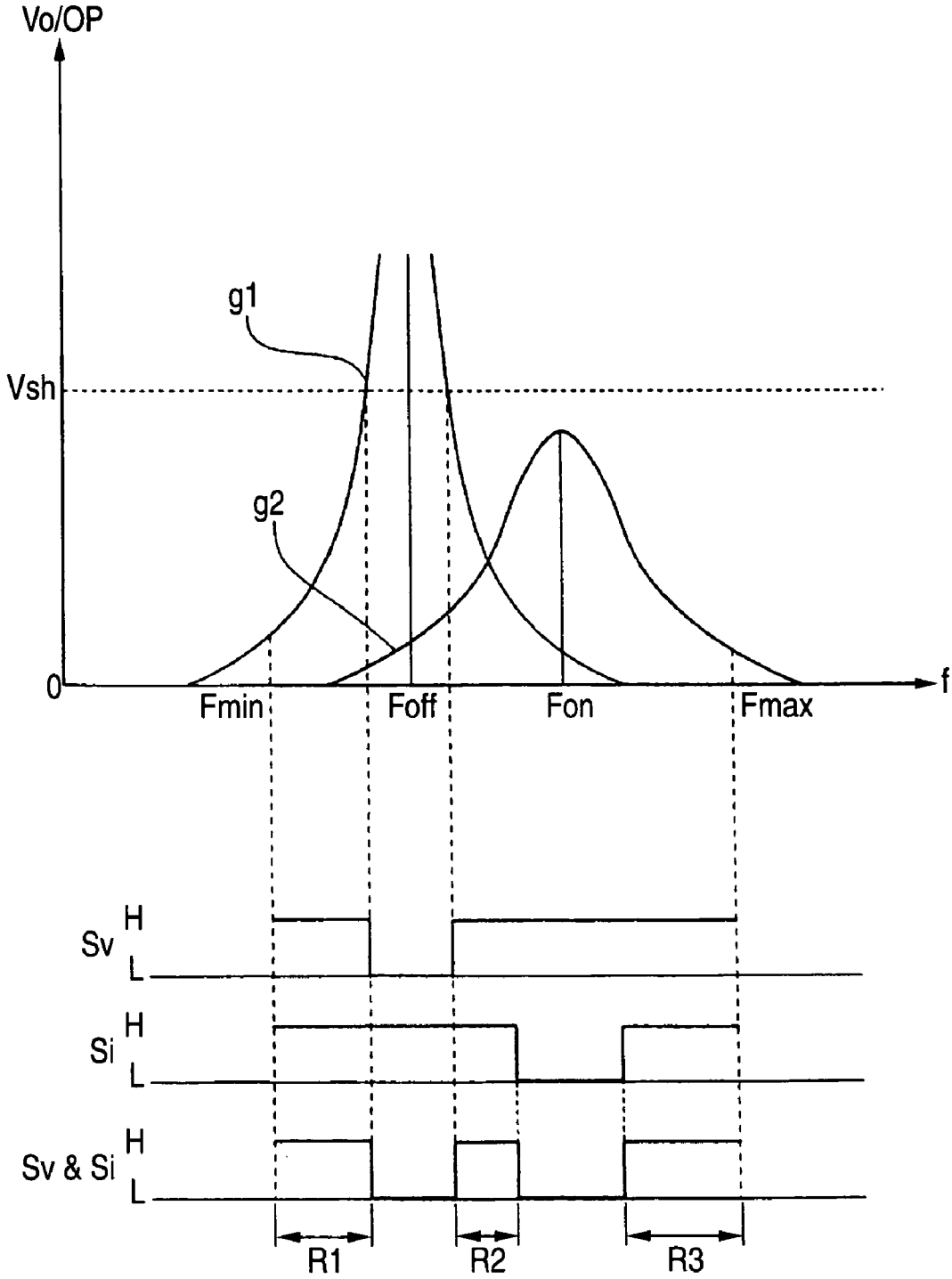
FIG. 6 is a diagram for explaining the detection condition for re-starting the lamp.

FIG. 6 is a explanatory diagram which shows the resonance curves g1 and g2 in the upper diagram and also shows the signals Sv, Si together with a logical product "Sv & Si" thereof in the lower diagram.

The signal Sv is compared with the threshold value "Vsh" shown in the figure as the comparison reference and exhibits an L level in the case of VL≧Vsh due to the OCV control before the lighting of the discharge lamp.

The signal S1 is compared with the threshold value "Ish" as the comparison reference and exhibits an L level in the case of IL≧Ish.

Thus, the logical product "Sv & Si" exhibits an H level in the following three cases in each of which each of the Sv and the Si exhibits an H level.

A range "R1" positioned on the low frequency side of the Foff.

A range "R2" positioned on the high frequency side of the Foff and on the low frequency side of the Fon.

A range "R3" positioned on the high frequency side of the Fon.

The range "R1" is a case where the aforesaid two conditions are satisfied. When the both conditions are continued for the predetermined set time period or more, a state of increasing the driving frequency of the switching elements higher then the Foff is temporarily generated thereby to start the shift to the OCV control.

The range "R2" is within a range corresponding to a transient period for shifting to the frequency range (see the region fb in FIG. 2) higher than the Fon after starting the lighting of the discharge lamp. Thus, it is necessary to exclude (or mask) this case as being not satisfying the aforesaid detection condition so that the reset operation is not performed within this range.

In the range "R3", when the discharge lamp is extinguished, the OCV control is started thereby to control the driving frequency of the switching elements so as to reduce it, so that the staying time period within this range does not reach or exceed the setting time period.

As described above, the ranges R2 and R3 can be excluded by taking into consideration of a temporal factor (the time period shifting to the region fb after starting the lighting of the discharge lamp and the reduction continuing time period of the lamp voltage and the lamp current) in addition to the detection information of the lamp voltage and the lamp current, and so only the R1 can be detected correctly.

As a method of directly detecting the lowering state of the driving frequency of the switching elements, it is considered to monitor the frequency by using a frequency-voltage (F-V) converter, for example. However, in view of such matters that the reliability of the threshold value for the frequency detection is degraded when taking into consideration of the unevenness of the element characteristics and the temperature characteristics etc. and that a general capacitor is required for the F-V converter thereby to cause the increase of the number of the terminals for a control IC and the increase of cost, a configuration capable of detecting the lowering state within the IC as described bellow is preferable.

Figure 7:
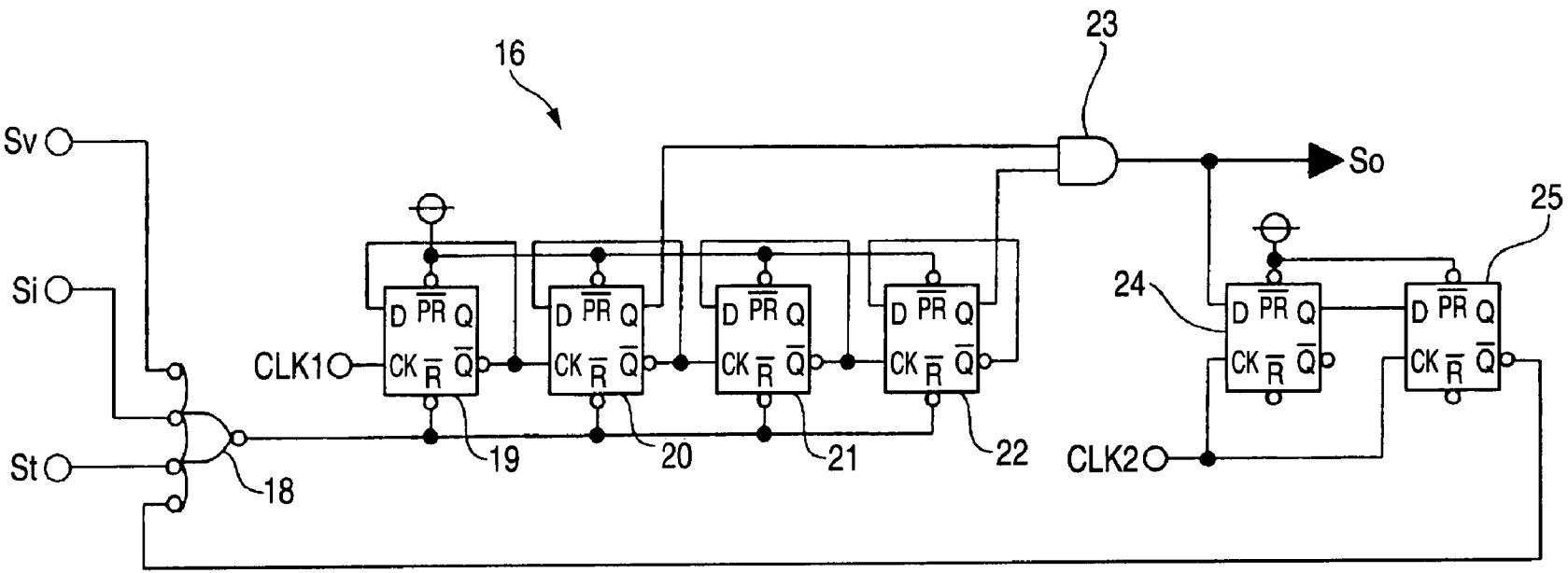
FIG. 7 is a diagram showing an example of the circuit configuration relating to a reset control portion.

FIG. 7 shows an example of the circuit configuration relating to the reset control portion 6*e*.

Signals Sv, Si and St are input into an gate 18, which in turn sends an output signal to the reset terminals (R) of D flip-flops 19 to 22 constituting the counter 16. The multi-input AND gate 18 is arranged to be a low (L) active input and to receive the output signal (a Q bar output, that is, a phase inverted output of a Q output) from a D flip-flop 25 described later and an initializing signal from a not-shown power-on reset circuit in addition to the signals Sv, Si and St. The signal St is a signal necessary for masking the range R2.

In each of the D flip-flops 19 to 22, each of a preset terminal (PR) and a reset terminal (R) is set to be an L active, and a power source terminal of a predetermined voltage is coupled to the preset terminal, and the reset terminal is coupled to the L active output terminal of the AND gate 18.

The D flip-flop 19 of the first stage is arranged in a manner that the clock input terminal (CK) thereof is supplied with a clock signal CLK1, and the D terminal thereof is coupled to the Q bar output terminal thereof and also to the clock input terminal (CK) of the D flip-flop 20 of the succeeding stage. In the similar manner, in each of the D flip-flops 20 and 21, the D terminal thereof is coupled to the Q bar output terminal thereof and also to the clock signal input terminal (CK) of the D flip-flop of the succeeding stage. Then, in the D flip-flop of the last stage, the D terminal thereof is coupled to the Q bar output terminal thereof.

The Q output terminals of the D flip-flop 20 of the second stage and the D flip-flop 22 and fourth stage are coupled to the input terminals of a two-input AND gate 23. The output signal of the two-input AND gate 23 is sent to the D terminal of a D flip-flop 24 and also output as the signal So.

In each of the D flip-flops 24 and 25, each of a preset terminal (PR) and a reset terminal (R) is set to be an L active, and a power source terminal of a predetermined voltage is coupled to the preset terminal, and the reset terminal is supplied with an initializing signal from a not-shown power on reset circuit. The clock signal input terminal (CK) of each of the D flip-flops 24 and 25 is supplied with a clock signal CLK2.

The Q output of the D flip-flop 24 is sent to the D terminal of the D flip-flop 25 of the succeeding stage, and the Q bar output of the D flip-flop 25 is sent to the AND gate 18 as the input signal thereof.

The output signal So of the AND gate 23 is sent to the V-F converter 6*a* via the calculation portion 6*f*. The V-F converter 6*a* employs a frequency variable oscillation circuit including a voltage variable capacitance diode, for example, and is arranged in a manner that the static capacitance of the voltage variable capacitance diode increases (reduces) as the input voltage vin increases (reduces) and so the frequency of the output pulse reduces (increases). The any configuration mode of a V-F converter can be applied. Further, such an embodiment may be employed in which the voltage-frequency characteristics in which the frequency increases in accordance with the increase of the Vin.

The threshold value Vsh relating to the detection of the lamp voltage VL is set to be smaller than the target value at the time of the OCV control and a minimum value capable of shifting to the lighting state of the discharge lamp. Further, the setting time of the counter 16 may be set almost in a range of 100 to 150 mm, for example, in view of the boosting time period in which the OCV increases to the Vsh and the staying time period within the range R3 etc. (the erroneous detection of the R3 may arise when the setting time is too short).

Figure 8:
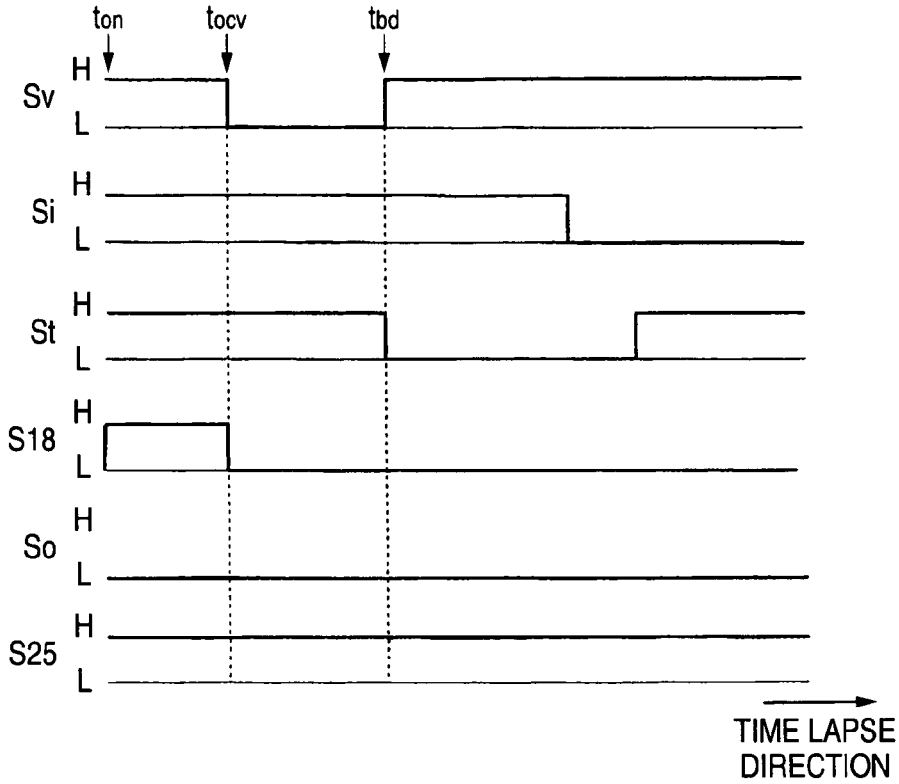
FIG. 8 is a timing chart for explaining the circuit operation together with FIG. 9 and showing a case where the discharge lamp shifts normally to the lighting state after starting the lighting.
Figure 9:
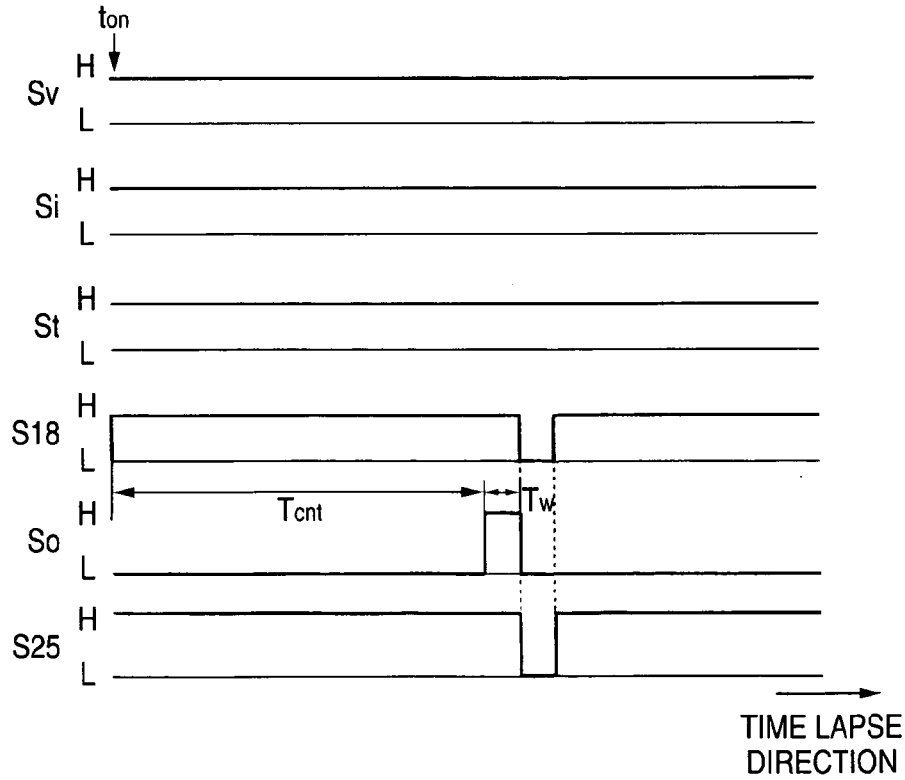
FIG. 9 is a diagram showing a case where the output stage of a lighting circuit is grounded on a high voltage side.

FIGS. 8 and 9 are timing charts for explaining the operation of the aforesaid circuits. FIG. 8 shows a case where the discharge lamp shifts normally to the lighting state after starting the lighting, and FIG. 9 shows a case where the output stage of the lighting circuit is grounded on the high voltage side.

The meanings of respective signs in the drawings are as follows.

"ton" is a time point where the power source is turned on.

"tocv" is a time point where the OCV reaches for the first time the threshold value Vsh or more.

"tbd" is a time point where the discharge lamp starts.

"S18" is the output signal of the AND gate 18.

"S25" is the Q bar output of the D flip-flop 25.

"Tcnt" is the setting time period of the counter 16.

"Tw" is the pulse width of the signal So.

The remaining signals are already explained above.

In FIG. 8, the output signal of the AND gate 18 is at the H level during a period until the OCV reaches the Vsh after the turning-on of the power source, but this period is shorter than the Tcnt. Thus, the counter 16 is reset at the time point tocv and so the signal So is kept at the L level.

In FIG. 9, the discharge lamp extinguishes due to the occurrence of the grounding and so the Si becomes at the H level. Further, the lamp voltage is smaller than the Vsh and so the Sv is at the H level. Since the St is at the H level, the output signal of the AND gate 18 is kept at the H level. Thus, the reset state of the counter 16 is cancelled and so the So becomes the H level with a pulse width Tw after the counting operation of the Tcnt.

Next, the mode (B) will be explained with reference to FIGS. 10 to 13.

Figure 10:
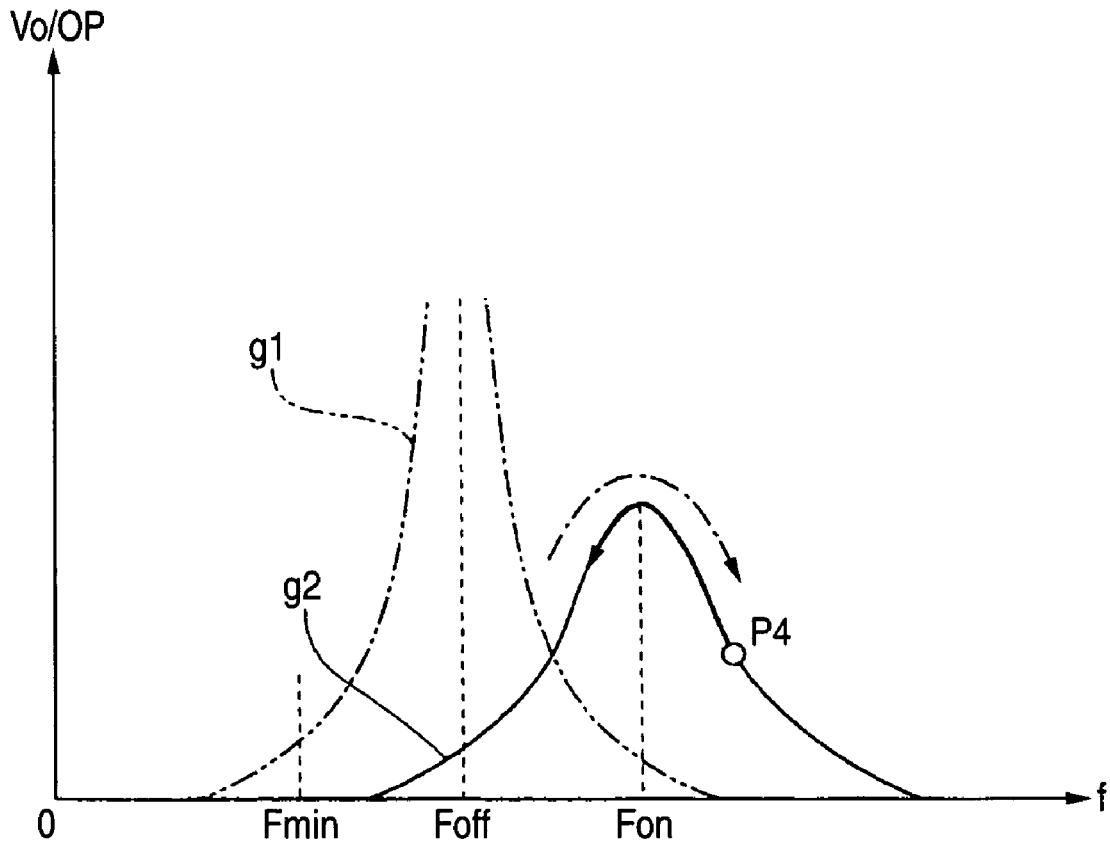
FIG. 10 is a diagram showing another control mode according to the invention together with FIGS. 11 to 13 and explanatorily showing an example of the frequency control.

FIG. 10 is a graph exemplarily showing the resonance curves g1 and g2, in which the ordinate represents the output voltage at the resonance curve g1 before the lighting and represents the output power OP at the resonance curve g2 after the lighting.

In this embodiment, the operation point P4 is positioned on the frequency side higher than the Fon on the resonance curve g2.

When it is detected that the driving frequency reduces lower than the Fon during the lighting of the discharge lamp, the control is performed so as to return the driving frequency to the inductive frequency region higher than the Fon as shown by an arrow of a chain line. That is, when the driving frequency enters into the capacitive frequency region lower than the Fon during the lighting of the discharge lamp, the control is performed so as to restore the driving frequency to the frequency region higher than the Fon while maintaining the lighting of the discharge lamp, thereby preventing such a phenomenon that the driving frequency continues to reduce (finally reaches the minimum frequency "Fmin") while being kept in the capacitive region.

In the case of detecting that the driving frequency reduces lower than the Fon, this reduction can be determined depending on whether or not the reduction tendency of the lamp current or the driving frequency is continued for a predetermined time period. The transient period (the period where the St is at the L level and see "ΔF" in FIG. 2) in the case where the driving frequency shifts to the frequency region higher than the Fon after the time point of starting the lighting of the discharge lamp is excluded (masked) from the determining condition.

Figure 11:
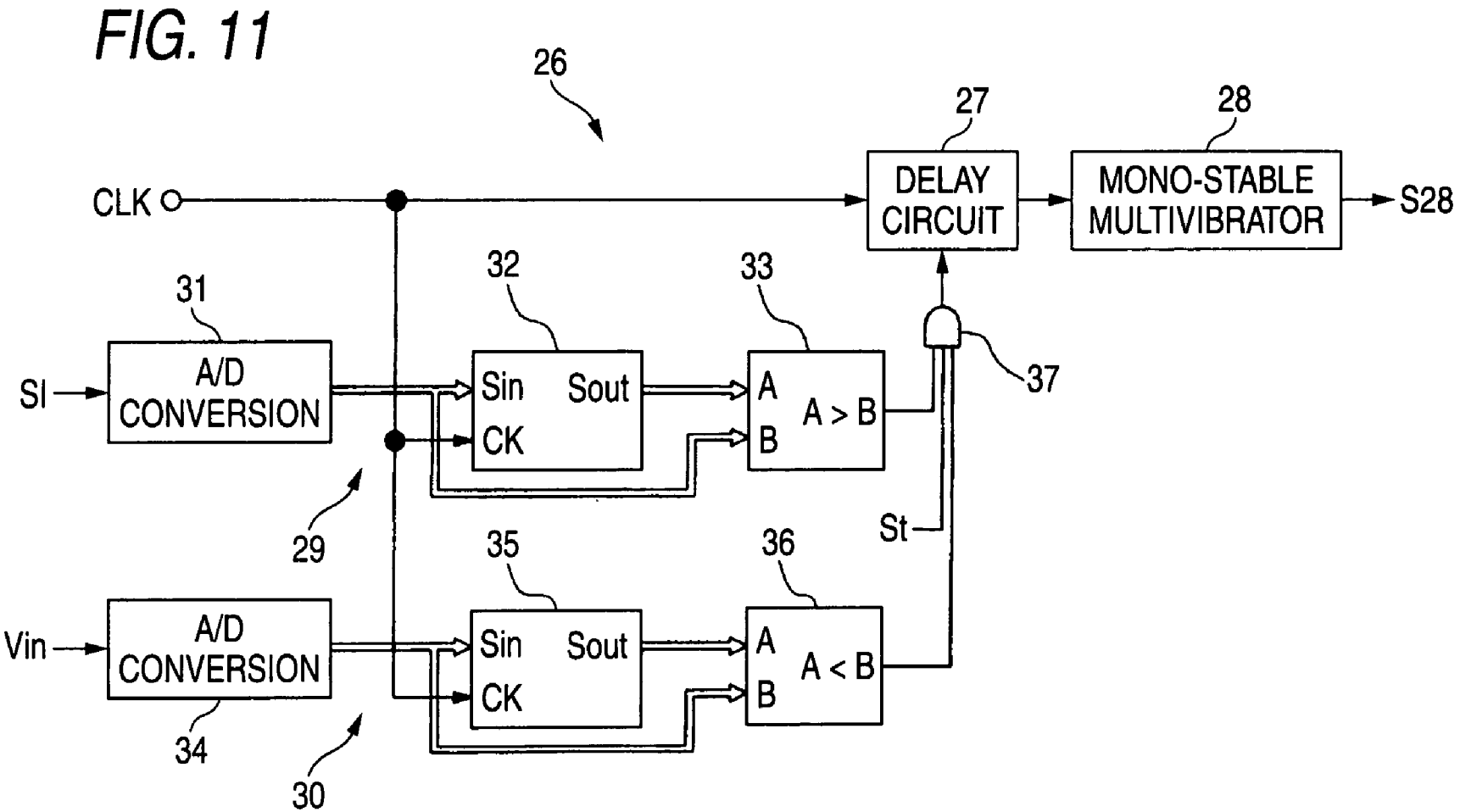
FIG. 11 is a diagram showing an example of the circuit configuration.

FIG. 11 shows an example of the circuit configuration 26 to which the invention is applied. This example may be used in place of the reset control portion 6*e* or may be provided in parallel to the reset control portion (see the restoring control portion 6*g* in FIG. 4).

In this embodiment, this circuit configuration includes a delay circuit 27 using a counter, a mono-stable multivibrator 28 disposed at the succeeding stage of the delay circuit, a current change detection portion 29 for detecting the reduction of the lamp current, and a frequency change detection portion 30 for detecting the reduction of the driving frequency.

A clock signal "CLK" obtained by a not-shown signal generation circuit is supplied to the counter constituting the delay circuit 27. When an H level signal output from the delay circuit is sent to the mono-stable multivibrator 28, the mono-stable multivibrator generates an output signal "S28" with a predetermined pulse width and sends this output signal to the calculation portion 6*f*.

The current change detection portion 29 is configured by an analog/digital (A/D) converter 31 for converting the detection signal ("SI") of the lamp current detected by using the current detector 12 or the lamp current detection resistor 14 into a digital signal, an N bit shift register 32 disposed at the succeeding stage of the A/D converter, and a magnitude comparator 33.

The output of the A/D converter 31 is supplied as a bit input (see "Sin" in the figure) to the N-bit shift register 32 and as one input (see "B" in the figure) to the magnitude comparator 33. The output (see "Sout" in the figure) of the N-bit shift register 32 serves as the other input (see "A" in the figure) to the magnitude comparator 33. The signal CLK is supplied to the clock signal input terminal (CK) of the N-bit shift register 32.

The output just after the A/D conversion represents the detection value of the lamp current IL at the current time point. The output of the N-bit shift register 32 represents the detection value of the lamp current IL at a past time point by N clock signals CLK. The magnitude comparator 33 compares the magnitudes between the two inputs thereof and outputs a binary signal according to an inequality condition of "A>B". That is, the comparator outputs an H level signal to an AND gate 37 when the lamp current at the current time point is smaller than that of the past time point (the reduction of the lamp current).

The frequency change detection portion 30 constitutes a detection unit for detecting the change of the driving frequency of the switching elements. This detection portion uses the frequency of the output signal of the calculation portion 6*f* (for example, the output signal of the error amplifier when the calculation portion is configured by using the error amplifier). That is, this output signal corresponds to the Vin and the increase (decrease) of the Vin corresponds to the decrease (increase) of the driving frequency of the switching elements. In this manner, since the driving frequency changes in a reverse manner with respect to the change of the Vin, the driving frequency can be indirectly monitored by using the Vin. The frequency change detection portion 30 is configured by an A/D converter 34 for converting the Vin into a digital signal, a N-bit shift register 35 disposed at the succeeding stage thereof and a magnitude comparator 36.

The output of the A/D converter 34 is supplied as a bit input (see "Sin" in the figure) to the N-bit shift register 35 and as one input (see "B" in the figure) to the magnitude comparator 36. The output (see "Sout" in the figure) of the N-bit shift register 35 serves as the other input (see "A" in the figure) to the magnitude comparator 36. The signal CLK is supplied to the clock signal input terminal (CK) of the N-bit shift register 35.

The output just after the A/D conversion represents the level of the Vin at the current time point. The output of the N-bit shift register 35 represents the level of the Vin at a past time point by N clock signals CLK. The magnitude comparator 36 compares the magnitudes between the two inputs thereof and outputs a binary signal according to an inequality condition of "A<B". That is, the comparator outputs an H level signal to the AND gate 37 when the lamp current at the current time point is larger than that of the past time point (the reduction of the driving frequency).

The three-input AND gate 37 outputs an H level signal (an enable signal) to the delay circuit 27 thereby to operate the delay circuit when each of the output signals of the magnitude comparators 33, 36 and the signal St is an H level. Then, upon the lapse of a preset time period, the delay circuit 27 outputs the signal to the mono-stable multivibrator 28 and so the mono-stable multivibrator sends the signal "S28" with the predetermined pulse width to the V-F converter 6*a* via the calculation portion 6*f*.

Figure 12:
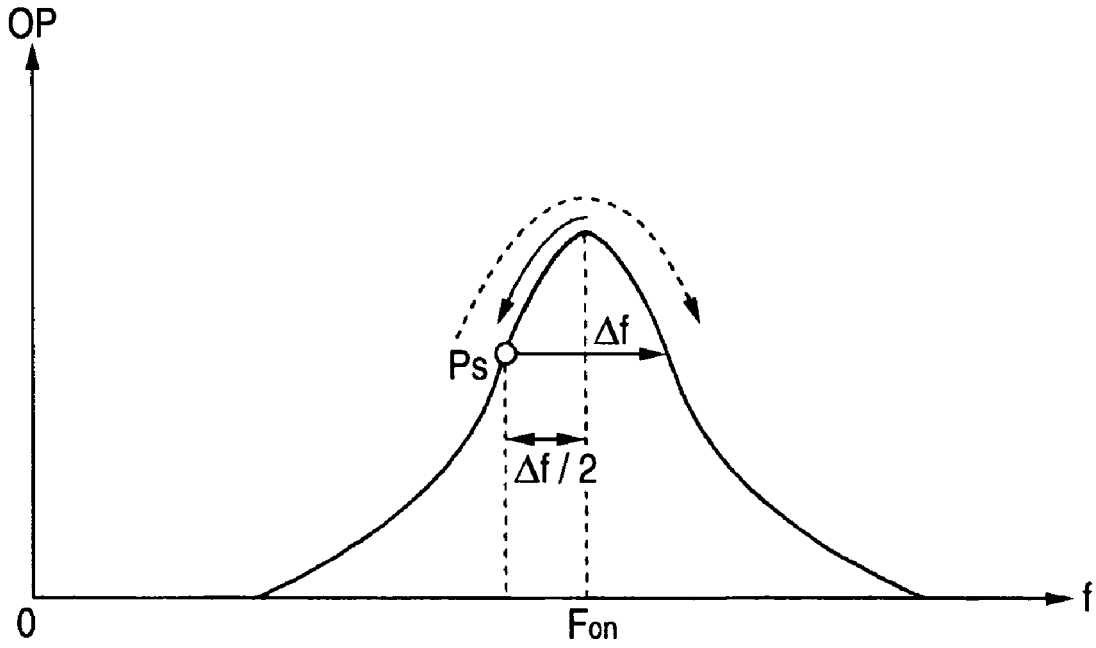
FIG. 12 is a diagram showing a state of the frequency shift to an inductive region from a capacitive region small than Fon in a resonance curve g2.

FIG. 12 is a graph which schematically shows a state in which, in the resonance curve g2 almost symmetrical with respect to the frequency "f=Fon", an operation point enters into a capacitive region smaller than the Fondue to the reduction of the frequency, then after the detection of a point "Ps", the operation point restores in the high frequency side region higher than the Fon due to the frequency change of "Δf".

When the operation point enters into the low frequency side region lower than the Fon as shown by an arrow of a steady line, this phenomenon is detected as the reduction of the SI by the current change detection portion 29 and the increase of the Vin (reduction of the driving frequency) by the frequency change detection portion 30. Then, upon the lapse of the preset time period by the delay circuit 27, the signal S28 temporarily exhibits the H level at the time point "Ps". The signal S28 sent to the V-F converter 6*a* via the calculation portion 6*f*. That is, when the signal S28 becomes the H level, the level of the output signal of the error amplifier within the calculation portion 6*f* reduces, which is reflected as the increment "Δf" of the frequency in the V-F converter 6*a*.

The set time period of the counter constituting the delay circuit 27 is set to be a time period from the time point where the driving frequency of the switching elements becomes the Fon to a time point where the driving frequency reduces by a half width of "Δf/2" from the Fon (within the range capable of maintaining the lighting state of the discharge lamp). That is, since the set time period of the counter is defined so that the reduction of the driving frequency is detected within a range of "Fon −Δf/2" in view of the characteristics of the control circuit, the smooth shift to the inductive region from the capacitive region can be guaranteed while maintaining the lighting state of the discharge lamp.

Figure 13:
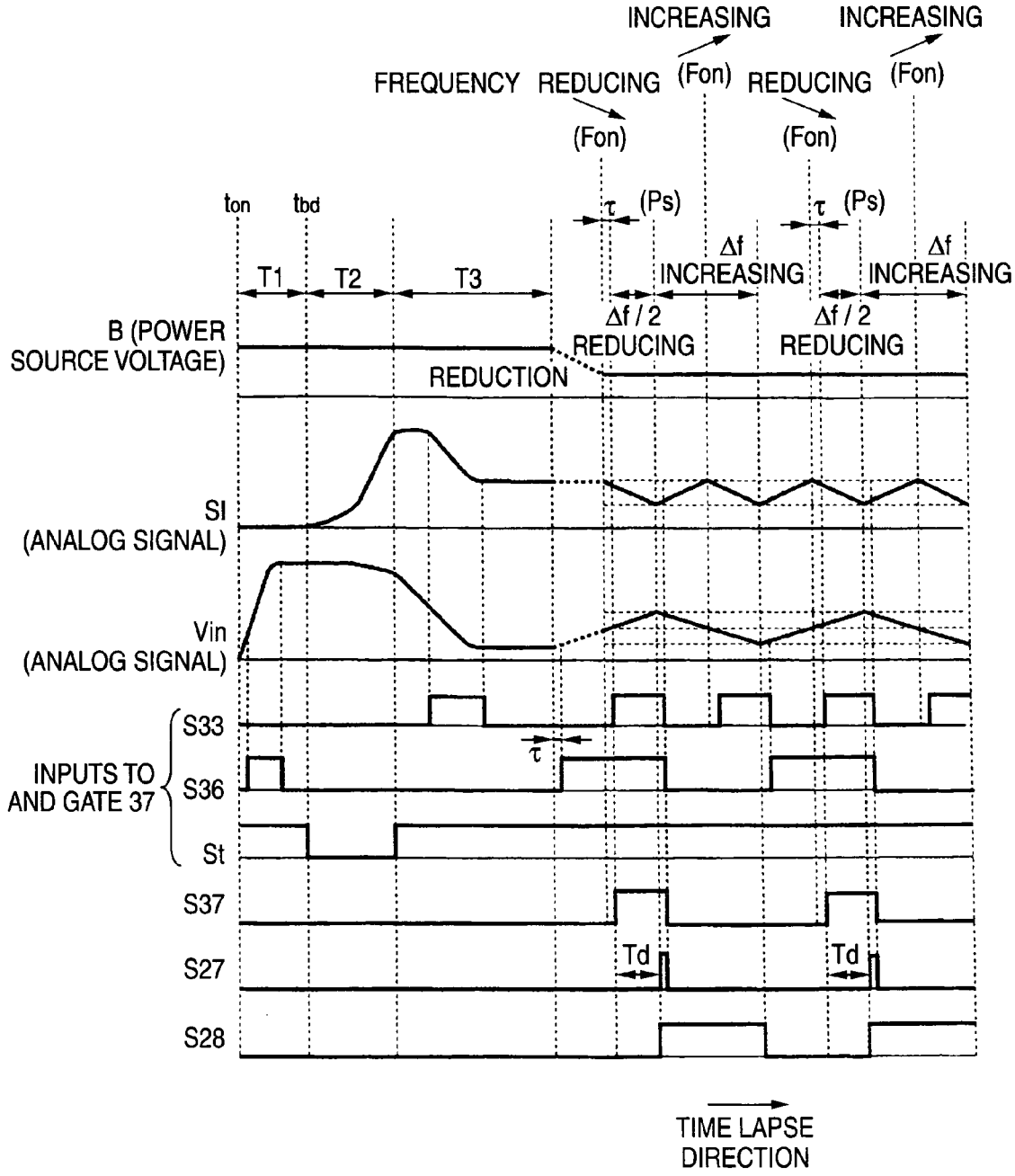
FIG. 13 is a timing chart showing an example of the control in the case where the driving frequency reduces lower than Fon during the lighting of the discharge lamp.

FIG. 13 is a timing chart showing an example of the control in the case where the driving frequency reduces so as to be lower than the resonance frequency Fon during the lighting state of the discharge lamp. The meanings of the respective signs in the drawings are as follows.

"S33" is the output signal of the magnitude comparator 33.

"S36" is the output signal of the magnitude comparator 36

"S37" is the output signal of the AND gate 37.

"S27" is the output signal of the delay circuit 27.

"S28" is the output signal of the mono-stable multivibrator 28.

The SI and the Vin are explained above and B represents the power source voltage of the lighting circuit.

Further, the meanings of time periods and time points in the figure are as follows.

"T1" is the control time period of the OCV (a time period between t on to t bd)

"T2" is a shift control time period (a time period where the St is at the L level) from a time point of starting the lighting to the region fb.

"T3" is a shift time period from a transient state to a steady control.

"Td" is a delay time period (representing the delay of the S27 starting from the rising edge of the S37).

"τ" is a delay time period of the magnitude comparator (33, 36).

At the upper right portion in the figure, there is shown the change of the driving frequency, in which (Fon) represents a time point where the driving frequency reaches the resonance frequency Fon, and (Ps) represents a time point where the driving frequency reaches the operation point Ps (see FIG. 12).

This embodiment shows the operations of the circuits in a state where the power source voltage B reduces due to some reason after the lighting of the discharge lamp after the turning-on of the power source, and a desired power can not be supplied to the discharge lamp even if the driving frequency is reduced to the resonance frequency Fon.

The detection signal SI of the lamp current increases during the time period T2, then, during the time period T3, the detection signal reaches the peak value, then reduces slightly and maintains almost the same value. The Vin increases during the time period Ti, then maintains within almost a constant range, then, during the time period T3, reduces and maintains almost the same value.

The S33 represents the H level while the SI reduces, whilst the S36 represents the H level while the Vin increases.

The St represents the H level except for the time period T2, whilst the S37 which is the logical product of the S33, S36 and St represents the H level when each of these three output signals is the H level.

The pulse S27 is output upon the lapse of the delay time of Td after the time point where the S37 becomes the H level. The Vin reduces and the driving frequency increases during the time period where the S28 is at the H level (see the frequency increase by Δf shown in FIG. 12).

According to this control, it is prevented from falling into such a state that, when the driving frequency reduces and enters into the capacitive region lower than the Fon, the driving frequency reduces continuously, so that the lighting state of the discharge lamp can be maintained. That is, in the example shown in FIG. 13, after the reduction of the power source voltage, the driving frequency varies near the resonance frequency Fon (within the range Δf shown in FIG. 12) and so the discharge lamp continues to lighten.

This embodiment shows the configuration that the delay circuit is used in the frequency shift control on the condition that the lighting state of the discharge lamp is maintained. However, it is not limited to such a configuration example and may be arranged in a manner that the driving frequency is restored to the inductive region immediately when both the reduction of the lamp current and the driving frequency is detected. Further, in a case where the extinction of the discharge lamp is detected during the control or the driving frequency of the switching elements reduces remarkably due to a fact that the control is not performed sufficiently by some reason, the driving frequency is set to a value higher than the Foff to shift the control to the OCV control thereby to restart the lamp as shown in (A).

According to the configuration as described above, the following various merits can be obtained.

The operation state in the capacitive region positioned on the low frequency side than the resonance frequency Foff is detected and so the circuit can be restarted.

Since on the condition that the lighting state of the discharge lamp is maintained the operation state can be restored to the inductive region on the higher frequency side than the Fon from the capacitive region positioned on the lower frequency side than the resonance frequency Fon, the reduction of the driving frequency can be prevented.

As compared with the configuration for monitoring the driving frequency of the switching elements by using the F-V converter, the above-mentioned configuration of the embodiment is excellent in the accuracy and the reliability and is advantageous in the simplification of the circuit configuration and the cost reduction.

In the case where the reduction of the DC input voltage occurs or the grounding at the output stage of the lighting circuit etc. occurs, the restart of the lamp can be guaranteed or the lighting state of the discharge lamp can be maintained (for example, the safety of the running during the night can be improved when applied to a vehicle lamp).

The circuit configuration is employed in which a pair of the switching elements (5H, 5L) and the transformer (7) serving as both the AC conversion and the boosting of the start signal are used is advantageous in the miniaturization, the increase to the high-frequency, the cost reduction etc.

Other implementations are within the scope of the claims.

I claim:

1. A discharge lamp lighting circuit comprising:

a DC/AC converter to receive a DC input voltage to perform a DC/AC conversion;

a starting circuit to supply a start signal to a discharge lamp; and a control unit to control an electric power output from the DC/AC converter, wherein the DC/AC converter includes a plurality of switching elements driven by the control unit, and a series resonance circuit having a capacitor and at least one of an inductance element and a transformer, wherein the control unit is operable to set a driving frequency of the switching elements to a value higher than a resonance frequency Fon thereby to drive and control the switching elements at a time of lighting the discharge lamp, and wherein the control unit is operable to shift the driving frequency to a frequency region which is higher than a resonance frequency Foff when it is detected that the driving frequency reduces and the discharge lamp is extinguished, and wherein Foff corresponds to a resonance frequency of the series resonance circuit at a time of extinguishing the discharge lamp and Fon corresponds to a resonance frequency of the series resonance circuit at a time of lighting the discharge lamp.

2. A discharge lamp lighting circuit according to claim 1, wherein when it is detected that the driving frequency reduces and the discharge lamp is extinguished, the driving frequency is set to an allowable upper limit frequency higher than the resonance frequency Fon thereby to restart the lamp.

3. A discharge lamp lighting circuit according to claim 1, further comprising: a voltage detector which detects a lamp voltage applied to the discharge lamp; and a current detector which detects a lamp current flowing into the discharge lamp, wherein when a state is continued for a predetermined time period or more that the lamp voltage detected by the voltage detector is lower than a threshold value and the lamp current detected by the current detector is lower than a threshold value, the driving frequency is shifted to the frequency region which is higher than the resonance frequency Foff.

4. A discharge lamp lighting circuit according to claim 2 further comprising: a voltage detector which detects a lamp voltage applied to the discharge lamp; and a current detector which detects a lamp current flowing into the discharge lamp, wherein when a state is continued for a predetermined time period or more that the lamp voltage detected by the voltage detector is lower than a threshold value and the lamp current detected by the current detector is lower than a threshold value, the driving frequency is shifted to the frequency region which is higher than the resonance frequency Foff.

5. A discharge lamp lighting circuit comprising:

a DC/AC converter to receive a DC input voltage to perform a DC/AC conversion;

a starting circuit to supply a start signal to a discharge lamp; and a control unit to control an electric power output from the DC/AC converter, wherein the DC/AC converter includes a plurality of switching elements driven by the control unit, and a series resonance circuit having a capacitor and at least one of an inductance element and a transformer, wherein the control unit is operable to set a driving frequency of the switching elements to a value higher than a resonance frequency Fon thereby to drive and control the switching elements at a time of lighting the discharge lamp, and wherein the control unit is operable to restore the driving frequency to a frequency region higher than the resonance frequency Fon when it is detected that the driving frequency reduces to a value lower than the resonance frequency Fon during the lighting of the discharge lamp; and wherein Fon corresponds to a resonance frequency of the series resonance circuit at a time of lighting the discharge lamp.

6. A discharge lamp lighting circuit according to claim 5, further comprising:

a current detector which detects a lamp current flowing into the discharge lamp; and a detection unit which detects the driving frequency or a control voltage for the driving frequency, wherein when a state is continued for a predetermined time period or more that the lamp current detected by the current detector reduces and reduction of the driving frequency is detected by the detection unit, the driving frequency is shifted to the frequency region which is higher than the resonance frequency Fon.

* * * * *